US007858541B2

(12) United States Patent
Kim

(10) Patent No.: US 7,858,541 B2
(45) Date of Patent: Dec. 28, 2010

(54) BACK PAD FOR ABRASIVE DISKS AND PREPARATION THEREOF

(75) Inventor: Jeung Woon Kim, Seoul (KR)

(73) Assignee: Suntek Industries Ltd. (KR)

( * ) Notice: Subject to any disclaimer, the term of this patent is extended or adjusted under 35 U.S.C. 154(b) by 981 days.

(21) Appl. No.: 11/499,310

(22) Filed: Aug. 3, 2006

(65) Prior Publication Data

US 2007/0224901 A1 Sep. 27, 2007

(30) Foreign Application Priority Data

Mar. 21, 2006 (KR) ..... 10-2006-0025616

(51) Int. Cl.

| | |
|---|---|
| ***B32B 5/26*** | (2006.01) |
| ***B32B 29/00*** | (2006.01) |
| ***B32B 38/04*** | (2006.01) |
| ***B24D 3/00*** | (2006.01) |
| ***B24D 3/20*** | (2006.01) |
| ***B24D 3/28*** | (2006.01) |

(52) U.S. Cl. ..... 442/245; 442/239; 442/243; 442/244; 442/247; 442/277; 442/283; 51/295; 51/298; 451/548; 156/272.2

(58) Field of Classification Search ..... None
See application file for complete search history.

(56) References Cited

U.S. PATENT DOCUMENTS

| | | | | |
|---|---|---|---|---|
| 5,586,926 | A | 12/1996 | Wedell et al. | |
| 6,093,482 | A * | 7/2000 | Park et al. | 428/293.4 |
| 2002/0174966 | A1 * | 11/2002 | Brauns et al. | 162/280 |
| 2005/0120636 | A1 | 6/2005 | Kim | |
| 2006/0026905 | A1 | 2/2006 | Kim | |

FOREIGN PATENT DOCUMENTS

| | | |
|---|---|---|
| WO | WO 93/15879 | 8/1993 |

OTHER PUBLICATIONS

Saville, B.P., Physical Testing of Textiles, Woodhead Publishing, 1999, pp. 77-80.*

* cited by examiner

*Primary Examiner*—Jennifer A Chriss
(74) *Attorney, Agent, or Firm*—Baker & Hostetler LLP

(57) ABSTRACT

A back pad comprising a nonwoven fabric, and at least one carbon and polyester fiber textile layers stacked thereon has an improved flexibility and provides an improved working environment, and thus, it can be advantageously used in the manufacturing of an abrasive disk.

7 Claims, 1 Drawing Sheet

BACK PAD FOR ABRASIVE DISKS AND PREPARATION THEREOF

FIELD OF THE INVENTION

The present invention relates to a back pad for an abrasive disk which has an improved flexibility and provides an improved working environment; and a method for preparing said back pad.

BACKGROUND OF THE INVENTION

An abrasive disk is usually prepared by coating an adhesive on a back pad disk, and bonding the back pad to a disk form of a coated abrasive body (comprised of a backsheet and a layer of an abrasive material), followed by heat-pressing. The back pad is generally prepared using glass fibers for dimensional stability, and a conventional abrasive disk comprising a glass fiber textile-containing back pad is shown in FIG. 1.

However, the glass fiber textile has problems in that it is heavy, expensive and stiff, which limits the use of such an abrasive disk.

It is also known that abrasive materials in the edge of the abrasive disk wear down quicker than those in other part of the disk during polishing, leading to lowering of the abrasion efficiency. Thus, the worn abrasive material region is usually ground out together with the unused abrasive materials on the other part of the abrasive disk, by a procedure known as "dressing". This dressing operation is generally performed in several steps, during which the glass fiber textile generates a glass-fiber dust which irritates the skin and respiratory system of the worker. Further, the glass fiber textile has unsatisfactory wear resistance, which leads to a poor productivity and an increase in the manufacturing cost.

SUMMARY OF THE INVENTION

Accordingly, it is a primary object of the present invention to provide a glass fiber-free back pad for an abrasive disk which shows improved dimensional stability, flexibility and life time, while providing a safe working environment; and a method for preparing said back pad.

In accordance with one aspect of the present invention, there is provided a back pad for an abrasive disk which comprises a nonwoven fabric, and at least one carbon and polyester fiber textile layers stacked on the nonwoven fabric.

In accordance with another aspect of the present invention, there is provided a method for preparing the back pad which comprises placing disk forms of at least one set of carbon and polyester fiber textiles on a disk form of a nonwoven fabric, the carbon and polyester fiber textiles being each in a dried state after impregnation-treatment with an adhesive resin, and applying heat and pressure to the stack of the nonwoven fabric and textiles.

BRIEF DESCRIPTION OF THE DRAWINGS

The above and other objects and features of the present invention will become apparent from the following description of the invention, when taken in conjunction with the accompanying drawings, which respectively show.

Figure 1:
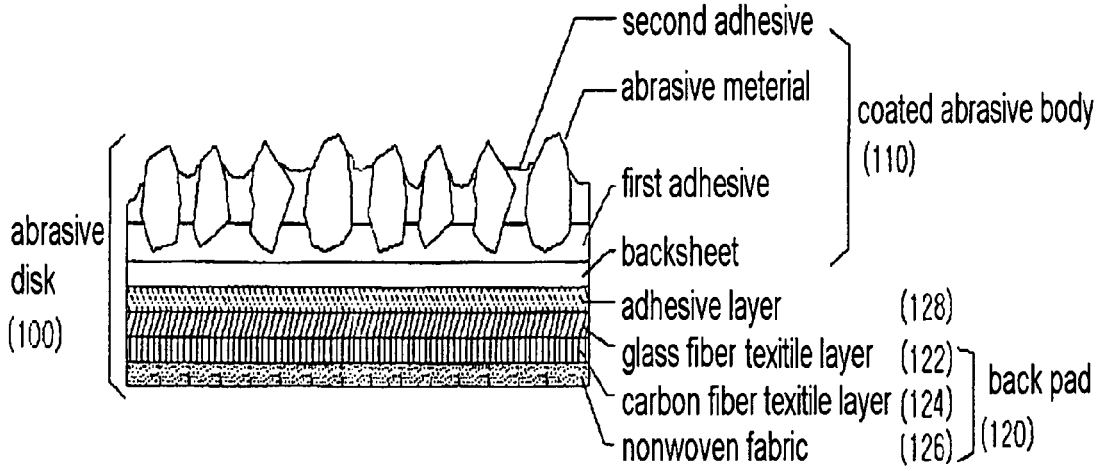
FIG. 1: a schematic diagram of an abrasive disk comprising a conventional back pad.

| | |
|---|---|
| 100: abrasive disk | 110: coated abrasive body |
| 120: back pad | 122: glass fiber textile layer |
| 124: carbon fiber textile layer | 126: nonwoven fabric |
| 128: adhesive layer | |
| 130: polyester fiber textile layer | |

DETAILED DESCRIPTION OF THE INVENTION

The inventive back pad comprises one nonwoven fabric, and at least two textile layers comprised of carbon and polyester fiber textiles, respectively, wherein the respective carbon and polyester fiber textiles are stacked on the nonwoven fabric in a multilayer form. Preferably, the inventive back pad has a structure comprising the nonwoven fabric, the carbon fiber textile layer and the polyester fiber textile layer which are sequentially stacked. In addition, if desired, two or more sets of the carbon and polyester fiber textile layers may be stacked on the nonwoven fabric.

The nonwoven fabric which is employed in the present invention preferably has a weight of 20 to 30 g/m$^2$ and a thickness of 0.1 to 0.3 mm.

The carbon and polyester fiber textiles which are employed in the present invention are each in a dried state after impregnation-treatment with an adhesive resin. The carbon fiber textile is made of G78 1/0×E225 1/0 (warp×fill)~H55 1/0×G150 1/0 (warp×fill) tex/yarn fibers and has a satin or plain fabric pattern of 48~70×26~37 (warp×fill) count/inch, wherein E, G and H mean that average diameters of the fibers are in the ranges of 6.35~7.61 μm, 8.89~10.15 μm and 10.16~11.42 μm, respectively, and the term "tex" means the gram weight of a 1000 m-long fiber.

The polyester fiber textile is made of 8/2~14/2×8/2~14/2 (warp×fill) s/yarn fibers and has a leno plain fabric pattern of 16~20×8~12 (warp×fill) count/inch. It is preferred that the polyester fiber textile is made of 12/2~14/2×8/2~10/2 (warp×fill) s/yarn fibers such that relatively thin and thick fibers are interwoven. Such a polyester fiber textile having the above-specified fiber thickness and fabric can be used, instead of a glass fiber textile, in producing a back pad having improved dimensional stability.

In addition, the polyester of the polyester fiber textile is a spun yarn, and suitable for this polyester is polyethylene terephthalate having a melting point ranging from 260 to 265° C.

The back pad in accordance with the present invention is manufactured by placing disk forms of at least one set of carbon and polyester fiber textiles on a disk form of a nonwoven fabric, wherein the carbon and polyester fiber textiles are each in a dried state after impregnation-treatment with an adhesive resin, and applying heat and pressure to the stack of the nonwoven fabric and textiles until they are fused together.

In one specific embodiment of the present invention, the back pad laminate may be prepared by placing a nonwoven fabric, the carbon fiber textile and the polyester fiber textile in order from the bottom into a mold, and then applying a pressure of 5 to 7 kgf/cm$^2$ thereto and heating the resulting stack in an oven of 120 to 170° C. for 4 to 10 hrs to allow the adhesive resin impregnated in the fibers to melt, resulting in the fusion of the components.

Representative examples of the adhesive resin employed in the impregnation-treatment of the carbon and polyester fiber textiles include a phenol resin, and a mixture of a phenol resin and a material selected from the group consisting of acrylonitrile-butadiene-rubber, polyester resin, polyvinyl butyral, epoxy resin, urea melamine and degenerated heat-curable resin. A Suitable phenol resin is a Rezole-type one having a solid content of 40 to 60% by weight and a viscosity of 300 to 600 cps at 25° C.

Figure 2:
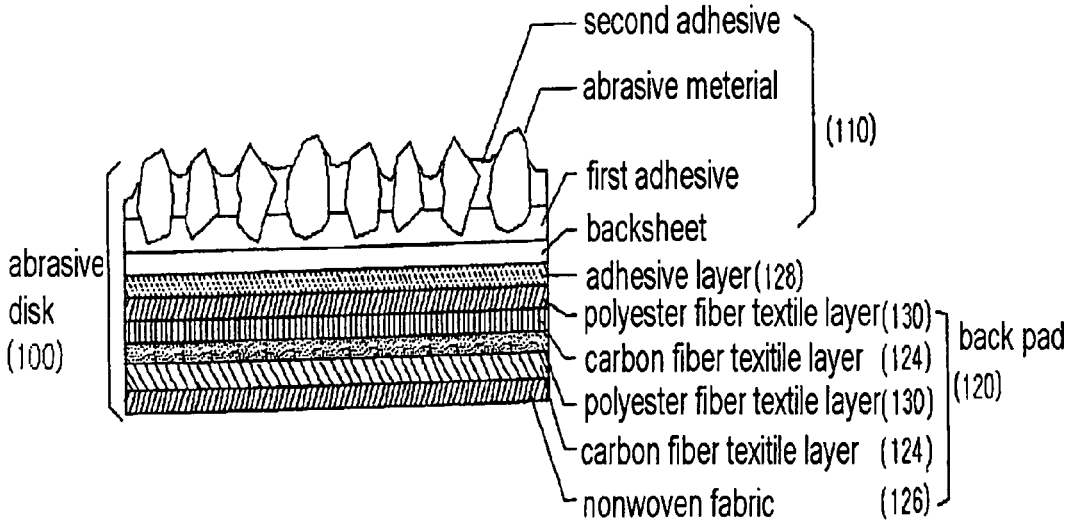
FIG. 2: a schematic diagram of an abrasive disk comprising a back pad in accordance with one embodiment of the present invention.

In the present invention, an abrasive disk may be prepared by a conventional method using the back pad thus obtained, e.g., by coating an adhesive on the textile layer surface of the back pad, adhering thereto a disk form of a coated abrasive body (comprised of a backsheet and a layer of an abrasive material) such that the backsheet of the coated abrasive body is bonded to the textile layer of the back pad, and heat-drying/aging the resulting combined disk at a temperature ranging from 80 to 120° C. for 2 to 5 hrs. The adhesive used for combining the back pad and the coated abrasive body may be any one of conventional adhesives. The abrasive disk comprising a back pad in accordance with one embodiment of the present invention is illustrated in FIG. 2.

The following Examples and Comparative Examples are given for the purpose of illustration only, and are not intended to limit the scope of the invention.

EXAMPLE 1

Cut into a disk form having an outer diameter of 180 mm and an inner diameter of 23 mm were: a 25 g/m$^2$ nonwoven fabric having a thickness of 0.15 mm; two carbon fiber textiles (commercially available from Korea Fiber Company) composed of G75 1/0×E225 1/0 (warp×fill) tex/yarn fibers (E and G mean that average diameters of the fibers are in the ranges of 6.35~7.61 μm and 8.89~10.15 μm, respectively) and having a satin fabric pattern of 52×30 (warp×fill) count/inch; and two polyethylene terephthalate fiber textiles (commercially available from Suntek Industries Ltd.) composed of 12/2×8/2 (warp×fill) s/yarn fibers and having a leno plain fabric pattern of 16×8 (warp×fill) count/inch. The carbon and polyethylene terephthalate fiber textiles had been dried after the treatment with a Rezole phenol resin.

The above-mentioned nonwoven fabric, one carbon fiber textile, one polyethylene terephthalate fiber textile, one carbon fiber textile and one polyethylene terephthalate fiber textile disks were sequentially stacked from the bottom up in a mold, and a steel press for fixing the disk was applied at a force of 6.0 kgf/cm$^2$ at an electric oven temperature of 150±5° C. for 5 hrs, to prepare the inventive back pad having the structure shown in FIG. 2.

EXAMPLE 2

Cut into a disk form having an outer diameter of 180 mm and an inner diameter of 23 mm were: a 25 g/m$^2$ nonwoven fabric having a thickness of 0.15 mm; two carbon fiber textiles (commercially available from Korea Fiber Company) composed of G75 1/0×E225 1/0 (warp×fill) tex/yarn and having a satin fabric pattern of 52×30 (warp×fill) count/inch; one polyethylene terephthalate fiber textile-(A) (commercially available from Suntek Industries Ltd.) composed of 12/2×8/2 (warp×fill) s/yarn fibers and having a leno plain fabric pattern of 16×8 (warp×fill) count/inch; and one polyethylene terephthalate fiber textile-(B) (commercially available from Suntek Industries Ltd.) composed of 12/2×12/2 (warp×fill) s/yarn fibers and having a leno plain fabric pattern of 16×8 (warp×fill) count/inch. The carbon and polyethylene terephthalate fiber textiles had been dried after the treatment with a Rezole phenol resin.

The above-mentioned nonwoven fabric, two carbon fiber textile, one polyethylene terephthalate fiber textile-(A) and one polyethylene terephthalate fiber textile-(B) disks were sequentially stacked from the bottom up in a mold. Thereafter, the procedure of Example 1 was repeated to prepare the inventive back pad.

EXAMPLE 3

Cut into a disk form having an outer diameter of 180 mm and an inner diameter of 23 mm were: a 25 g/m$^2$ nonwoven fabric having a thickness of 0.15 mm; two carbon fiber textiles (commercially available from Korea Fiber Company) composed of G75 1/0×E225 1/0 (warp×fill) tex/yarn fibers and having a satin fabric pattern of 52×30 (warp×fill) count/inch; and two polyethylene terephthalate fiber textiles (commercially available from Suntek Industries Ltd.) composed of 14/2×8/2 (warp×fill) s/yarn fibers and having a leno plain fabric pattern of 16×8 (warp×fill) count/inch. The carbon and polyethylene terephthalate fiber textiles had been dried after the treatment with a Rezole phenol resin.

The above-mentioned nonwoven fabric, two carbon fiber textile and two polyethylene terephthalate fiber textile disks were sequentially stacked from the bottom up in a mold. Thereafter, the procedure of Example 1 was repeated to prepare the inventive back pad.

COMPARATIVE EXAMPLE 1

Cut into a disk form having an outer diameter of 180 mm and an inner diameter of 23 mm were: a 25 g/m$^2$ nonwoven fabric having a thickness of 0.15 mm; and four glass fiber textiles (commercially available from Korea Fiber Company) composed of H45 1/3×H45 1/3 (warp×fill) tex/yarn fibers and having a leno plain fabric pattern of 8×8 (warp×fill) count/inch (H means that an average diameter of the fiber is in the range of 10.16~11.42 μm). The glass fiber textiles had been dried after the treatment with a Rezole phenol resin.

The above-mentioned nonwoven fabric and four glass fiber textile disks were sequentially stacked from the bottom up in a mold. Thereafter, the procedure of Example 1 was repeated to prepare a back pad.

COMPARATIVE EXAMPLE 2

Cut into a disk form having an outer diameter of 180 mm and an inner diameter of 23 mm were: a 25 g/m$^2$ nonwoven fabric having a thickness of 0.15 mm; and four glass fiber textiles (commercially available from Korea Fiber Company) composed of H50 1/4×H50 1/4 (warp×fill) tex/yarn fibers and having a leno plain fabric pattern of 9×9 (warp×fill) count/inch. The glass fiber textiles had been dried after the treatment with a Rezole phenol resin.

The above-mentioned nonwoven fabric and four glass fiber textile disks were sequentially stacked from the bottom up in a mold. Thereafter, the procedure of Example 1 was repeated to prepare a back pad.

COMPARATIVE EXAMPLE 3

Cut into a disk form having an outer diameter of 180 mm and an inner diameter of 23 mm were: a 25 g/m$^2$ nonwoven fabric having a thickness of 0.15 mm; two glass fiber textiles (commercially available from Korea Fiber Company) composed of H45 1/4×H45 1/4 (warp×fill) tex/yarn fibers and having a leno plain fabric pattern of 8×8 (warp×fill) count/inch; and two carbon fiber textiles (commercially available from Korea Fiber Company) composed of G75 1/0×E225 1/0 (warp×fill) tex/yarn fibers and having a satin fabric pattern of 52×30 (warp×fill) count/inch. The glass and carbon fiber textiles had been dried after the treatment with a Rezole phenol resin.

The above-mentioned nonwoven fabric, two glass fiber textile and two carbon fiber textile disks were sequentially stacked from the bottom up in a mold. Thereafter, the procedure of Example 1 was repeated to prepare a back pad.

COMPARATIVE EXAMPLE 4

Cut into a disk form having an outer diameter of 180 mm and an inner diameter of 23 mm were: a 25 g/m$^2$ nonwoven fabric having a thickness of 0.15 mm; two glass fiber textiles (commercially available from Korea Fiber Company) composed of H50 1/4×H50 1/4 (warp×fill) tex/yarn fibers and having a leno plain fabric pattern of 9×9 (warp×fill) count/inch; and two carbon fiber textiles (commercially available from Korea Fiber Company) composed of G75 1/0×E225 1/0 (warp×fill) tex/yarn fibers and having a satin fabric pattern of 52×30 (warp×fill) count/inch. The glass and carbon fiber textiles had been dried after the treatment with a Rezole phenol resin.

The above-mentioned nonwoven fabric, two glass fiber textile and two carbon fiber textile disks were sequentially stacked from the bottom up in a mold. Thereafter, the procedure of Example 1 was repeated to prepare a back pad.

COMPARATIVE EXAMPLE 5

Cut into a disk form having an outer diameter of 180 mm and an inner diameter of 23 mm were: a 25 g/m$^2$ nonwoven fabric having a thickness of 0.15 mm; one glass fiber textile (commercially available from Korea Fiber Company) composed of H45 1/3×H45 1/3 (warp×fill) tex/yarn fibers and having a leno plain fabric pattern of 8×8 (warp×fill) count/inch; one carbon fiber textile (commercially available from Korea Fiber Company) composed of G75 1/0×E225 1/0 (warp×fill) tex/yarn fibers and having a satin fabric pattern of 52×30 (warp×fill) count/inch; and two polyethylene terephthalate fiber textiles (commercially available from Suntek Industries Ltd.) composed of 12/2×12/2 (warp×fill) s/yarn fibers and having a leno plain fabric pattern of 16×8 (warp×fill) count/inch. The glass, carbon and polyethylene terephthalate fiber textiles had been dried after the treatment with a Rezole phenol resin.

The above-mentioned nonwoven fabric, one glass fiber textile, one carbon fiber textile and two polyethylene terephthalate fiber textile disks were sequentially stacked from the bottom up in a mold. Thereafter, the procedure of Example 1 was repeated to prepare a back pad.

COMPARATIVE EXAMPLE 6

Cut into a disk form having an outer diameter of 180 mm and an inner diameter of 23 mm were: a 25 g/m$^2$ nonwoven fabric having a thickness of 0.15 mm; one glass fiber textile (commercially available from Korea Fiber Company) composed of H50 1/4×H50 1/4 (warp×fill) tex/yarn fibers and having a leno plain fabric pattern of 9×9 (warp×fill) count/inch; one carbon fiber textile (commercially available from Korea Fiber Company) composed of G75 1/0×E225 1/0 (warp×fill) tex/yarn fibers and having a satin fabric pattern of 52×30 (warp×fill) count/inch; and two polyethylene terephthalate fiber textiles (commercially available from Suntek Industries Ltd.) composed of 12/2×8/2 (warp×fill) s/yarn fibers and having a leno plain fabric pattern of 16×8 (warp×fill) count/inch. The glass, carbon and polyethylene terephthalate fiber textiles had been dried after the treatment with a Rezole phenol resin.

The above-mentioned nonwoven fabric, one glass fiber textile, one carbon fiber textile and two polyethylene terephthalate fiber textile disks were sequentially stacked from the bottom up in a mold. Thereafter, the procedure of Example 1 was repeated to prepare a back pad.

Characteristics Test

The characteristics of the respective back pads obtained in Examples 1 to 3 and Comparative Examples 1 to 6 were measured in terms of tensile strength, rotation breakage strength, flexibility, degree of skin irritation of a worker affected with, dimensional stability and use time (life time). The results are shown in Table 1.

TABLE 1

| | Substrate (back pad) | | | | | | | | |
|---|---|---|---|---|---|---|---|---|---|
| | Ex.1 | Ex.2 | Ex.3 | Comp. Ex.1 | Comp. Ex.2 | Comp. Ex.3 | Comp. Ex.4 | Comp. Ex.5 | Comp. Ex.6 |
| Tensile Strength (kgf/in)*1 | 300~350 | 300~350 | 300~350 | 150~170 | 170~190 | 250~300 | 270~320 | 250~300 | 270~320 |
| Rotation Breakage Strength (rpm)*2 | 29,000~32,000 | 29,000~32,000 | 29,000~32,000 | 20,000~21,000 | 21,000~22,000 | 24,000~26,000 | 25,000~27,000 | 25,000~27,000 | 26,000~28,000 |
| Flexibility*3 | 4.0 | 3.8 | 3.8 | 6.0 | 7.0 | 5.0 | 5.0 | 4.5 | 4.5 |
| Degree of skin irritation | No irritation | No irritation | No irritation | Serious irritation | Serious irritation | Slight irritation | Slight irritation | Slight irritation | Slight irritation |
| Dimensional stability | Good | Good | Good | Good | Good | Good | Good | Good | Good |

TABLE 1-continued

| | Substrate (back pad) | | | | | | | | |
|---|---|---|---|---|---|---|---|---|---|
| | Ex.1 | Ex.2 | Ex.3 | Comp. Ex.1 | Comp. Ex.2 | Comp. Ex.3 | Comp. Ex.4 | Comp. Ex.5 | Comp. Ex.6 |
| Use time(sec)*4 | 60.0 | 60.0 | 55.0 | 30.0 | 32.0 | 38.0 | 40.0 | 45.0 | 46.0 |

Note:

*1: Tensile strength-measuring instrument-LLOYD Instruments type LR5R

*2: Rotation number at which a back pad is broken

*3: Pliableness ←---------- I ----------→ Stiffness
1 5 10

*4: Time to bring a 7"-sized back pad to 4"-sized when the back pad is subjected to dressing by a #36 coated abrasive body while rotating at a rate of 10,000 rpm under a pressure of 2 kgf/cm$^2$ As can be seen from Table 1, the inventive back pads of Examples 1 to 3 exhibit higher tensile strength, higher rotation breakage strength and better flexibility and coordinate dimensional stability, as compared to the back pads of Comparative Examples 1 to 6 containing glass fiber textiles. Further, the inventive back pads are environment-friendly in that dusts generated during the course of usage do not irritate workers' skin, and they can be used for a prolonged time, thereby greatly increasing productivity and lowering the manufacturing cost.

As described above, the inventive back pad which contains no glass fiber textile shows improved dimensional stability, improved flexibility, high elasticity, high resistance to breakage by load or rapid rotation during the course of usage, long life time and good environmental acceptability. Thus, an abrasive disk comprising said back pad can be advantageously employed in various abrasion applications.

While the invention has been described with respect to the above specific embodiments, it should be recognized that various modifications and changes may be made to the invention by those skilled in the art which also fall within the scope of the invention as defined by the appended claims.

What is claimed is:

1. A glass fiber-free back pad for an abrasive disk comprising a nonwoven fabric and two or more sets of carbon and polyester fiber textile layers stacked on the nonwoven fabric, the carbon fiber textile being made of G78 1/0-H55 1/0×E225 1/0-G150 1/0 (warp×fill) tex/yarn and has a satin or plain fabric pattern of 48-70×26-37 (warp×fill) count/inch.

2. The back pad of claim 1, wherein the nonwoven fabric, the carbon fiber textile layer and the polyester fiber textile layer are sequentially stacked.

3. The back pad of claim 1, wherein the weight and thickness of the nonwoven fabric are in the ranges of 20 to 30 g/m$^2$ and 0.1 and 0.3 mm, respectively.

4. A method for preparing the back pad of claim 1 which comprises placing disk forms of at least one set of carbon and polyester fiber textiles on a disk form of a fabric, the carbon and polyester fiber textiles being each in a dried state after impregnation-treatment with an adhesive resin, and applying heat and pressure to the stack of nonwoven fabric and textiles.

5. The method of claim 4, wherein the heat and pressure applied to the stack of the nonwoven fabric and textiles are in the ranges of 120 to 170° C. and 5 to 7 kgf/cm$^2$, respectively.

6. The method of claim 4, wherein the adhesive resin employed in the impregnation-treatment of the textiles is a phenol resin, or a mixture of a phenol resin and a material selected from the group consisting of acrylonitrile-butadiene-rubber, polyester resin, polyvinyl butyral, epoxy resin, urea melamine and degenerated heat-curable resin.

7. An abrasive disk which is obtained by combining a disk form of the back pad of claim 1 and a disk form of a coated abrasive body by using an adhesive.

* * * * *